United States Patent [19]

Nakamura

[11] Patent Number: 4,912,690

[45] Date of Patent: Mar. 27, 1990

[54] TIMEPIECE MOVEMENT

[75] Inventor: Norihiko Nakamura, Tokyo, Japan

[73] Assignee: Rhythm Watch Co., Ltd., Tokyo, Japan

[21] Appl. No.: 270,472

[22] Filed: Nov. 8, 1988

Related U.S. Application Data

[63] Continuation of Ser. No. 19,546, Feb. 26, 1987, abandoned.

[30] Foreign Application Priority Data

| | | | |
|---|---|---|---|
| Mar. 3, 1986 | [JP] | Japan | 61-45882 |
| Mar. 3, 1986 | [JP] | Japan | 61-30249[U] |
| Mar. 3, 1986 | [JP] | Japan | 61-30250[U] |
| Mar. 3, 1986 | [JP] | Japan | 61-30251[U] |
| Mar. 3, 1986 | [JP] | Japan | 61-30252[U] |
| Mar. 3, 1986 | [JP] | Japan | 61-30253[U] |

[51] Int. Cl.[4] ..... G04B 19/04; G04B 19/02

[52] U.S. Cl. ..... 368/80; 368/220; 368/223

[56] References Cited

U.S. PATENT DOCUMENTS

| | | | |
|---|---|---|---|
| 1,036,485 | 8/1912 | Greenwald | 368/234 |
| 2,248,195 | 7/1941 | Prins | 368/234 |
| 2,312,391 | 3/1943 | Cusin | 368/276 |
| 3,816,779 | 6/1974 | Lundin | 368/160 |
| 3,971,207 | 7/1976 | Murakami et al. | 368/282 |
| 3,973,706 | 8/1976 | Boyce et al. | 368/204 |
| 4,228,696 | 10/1980 | Kato | 368/80 |
| 4,316,277 | 2/1982 | Endo | 368/88 |
| 4,400,091 | 8/1983 | Ogihara et al. | 368/80 |
| 4,416,550 | 11/1983 | Wolber et al. | 368/76 |
| 4,496,246 | 1/1985 | Ota et al. | 368/220 |

FOREIGN PATENT DOCUMENTS

| | | | |
|---|---|---|---|
| 55-33647 | 3/1980 | Japan | 368/88 |

*Primary Examiner*—Vit W. Miska

*Attorney, Agent, or Firm*—Koda and Androlia

[57] ABSTRACT

A clock movement for table or wall clocks, the movement including at least a synchronous motor section and analog display section, the synchronous motor section adapted to receive a fixed cycle pulse signal to rotatably drive analog indicating hands at a fixed speed.

The synchronous motor section includes an elongated C-shaped stator disposed within a case and a rotor rotatably supported by the case and rotated between stator poles of the stator, the rotor having a rotor pinion engaged by a first reduction wheel, the rotation of the first reduction wheel being transmitted to the analog indicating hands through a time indicating gear train, both of the first reduction wheel and time indicating gear train being disposed within the case.

The gear train from the rotor to the time indicating gear train is disposed on a straight or curved line extending from the central stator axis to provide an elongated configuration to the movement case.

2 Claims, 11 Drawing Sheets

TIMEPIECE MOVEMENT

This is a continuation of application Ser. No. 019,546, filed Feb. 26, 1987, now abandoned.

BACKGROUND OF THE INVENTION

1. Field of the Invention:

The present invention relates to a timepiece movement and particularly to a small-sized movement driven by a synchronous motor in a clock such as wall clock, table clock and the like.

2. Description of the Prior Art:

Most of the clocks such as table clocks and wall clocks have been crystal clocks utilizing a crystal oscillator which provided a high accuracy oscillation. Such a crystal oscillator serves as a source of time reference oscillation to secure very well accuracy of time indication.

In such crystal clocks, a movement includes a main mechanism for rotatably driving tim indicating hands by the use of electrical clock pulses. Such a mechanism is generally divided into a synchronous motor section and a gear train section.

The synchronous motor section includes a stator coil to which high accuracy clock pulses obtained by dividing the frequency of crystal oscillation are applied, a stator having stator poles placed under the action of the magnetic flux in the stator coil, and a rotor rotated within the stator poles. On the other hand, the gear train section functions to gradually reduce the velocity of the rotating rotor and to transmit the rotation of the rotor to clock hands.

The external form of the conventional clock movements is normally of substantially circular or square shape for such a purpose that all the parts of the movement should be located about the hour hand of a clock as possible.

If a clock movement has a synchronous motor and a clock gear train arranged about the hour hand, the clock movement can freely be used for either of the wall or table clock. When one or more of external parts such as dial plate, indicating hands and decorative case are changed to other parts for a single type of clock, the latter can be converted into another type of clock.

Since the conventional movements have parts arranged about the hour hand as described, however, the movements are necessarily increased in thickness. If the gear train includes two or three wheel layers, this makes the assembly of the clock difficult in addition to the increased thickness of the movement.

The conventional movements have a further problem in that they cannot sufficiently deal with a certain design of clock. Such a design of clock includes, for example, a clock having a concealed movement. Such a clock has a mechanism for driving time indicator hands which mechanism cannot easily be viewed. This provides a unique design for the clock. Probably, such a unique design will make a new genre for clock design. However, it is extremely difficult to completely conceal all the parts arranged about the hour hand of the clock.

There has been proposed a skeleton clock which is intended to conceal its movement as possible. However, this also could not provide a movement which was satisfactorily concealed.

There is also a proposal to provide a small-sized movement suitable for use in a concealed movement type of clock. In such a case, the small-sized movement must provide a satisfactorily large driving torque. The concealed movement type clock requires time indicator hands which are sufficiently large in comparison with the small size of the movement. This intends to give a question to a user in that such large and long hands cannot be driven only by a mechanism assembled into any one strut or column. Such a question will make the user to recognize a new design for the clock.

On the other hand, however, the synchronous motor must provide an increased torque for driving the large and long hands in the small-sized movement of the clock. In the prior art, such an increased torque was accomplished by increasing the magnetic flux in the rotor. The increase of the torque causes a magnetic connection between the rotor and any metallic part located near the rotor. Particularly, when the small-sized movement has a battery as a source of current supply arranged near the rotor, the latter is magnetically attracted toward the battery to create an unnecessary inclination in the rotor which will cause various malfunctions.

With the small-sized clock movement suitable for use in concealed movement type clocks and capable of driving the large and long hands, therefore, the positional relationship between the rotor and the battery is a very important factor.

Further, the clock movement may include an analog display section to be driven by the synchronous motor. The synchronous motor receives a given drive signal (normally, a fixed cycle pulse signal) from a drive section. The drive section includes a motor drive circuit and a battery.

The analog display section is assembled with the drive section to form a unitary clock movement. However, such a unitary clock movement tends to increase the whole size of the movement and is particularly disadvantageous for the concealed movement type clocks as aforementioned.

SUMMARY OF THE INVENTION

It is therefore an object of the present invention to provide a new and inconspicuous clock movement suitable for use in the concealed movement type clocks, which is of a reduced size and provides a higher driving force.

To this end, the present invention provides a new clock movement having its whole elongated configuration and comprising a synchronous motor section and a clock gear train section, these sections being basically arranged in a line, the movement further comprising time indicator hands capable of being disposed at or near the distal end of the movement.

Thus, the clock movement still further comprises a stator of longitudinally extending C-shaped configuration, the stator having a pair of parallel legs, one of which includes a stator coil wound therearound. The stator also includes a central axis extending between the legs, a rotor located on the central axis and a first reduction wheel (or fifth wheel) similarly located on the central axis. Such an arrangement can make the movement to be small-sized and to provide a sufficient driving force.

In addition to the rotor and first reduction wheel, the clock movement includes time indicating gear train arranged in a straight line along the central stator axis or in a curved line contacting the central stator axis. This can provide a small-sized movement of an elongated configuration which extends from the stator to the gear train.

In accordance with the present invention, therefore, the elongated movement can completely be concealed within a hollow strut for supporting the time indicator hands, in contrast with the conventional movements of circular or square configuration in which the parts are collected and mounted about the time indication shaft. Since the movement of the present invention is of a small-sized, but yet provides an increased drive force, the time indicator shaft on which the long and large hands are mounted cannot externally be viewed to have its driving mechanism located within the shaft itself. Thus, there can be provided a unique design as if its time indicator hands are rotated without any drive mechanism.

In accordance with the present invention, the elongated movement can provide an unexpectedly increased degree of freedom in the actual design.

The present invention also provides an elongated clock movement comprising a synchronous motor arranged in a line relative to a time indicating gear train and time indicating hands mounted on the distal end of the movement, thereby providing a sufficiently large space formed about the time indicating shaft.

In accordance with the present invention, therefore, the elongated clock movement can provide a spatial region extending through a sufficiently increased angle, for example, 200 degrees about the time indicating shaft except a certain region. If such a spatial region is covered by a transparent dial plate or the like, the time indicating shaft on which the long indicator hands are mounted cannot externally be viewed to have their drive mechanism. This also provides a unique design as if the indicating hands rotate without any drive mechanism.

The present invention further provides an elongated and thinned movement comprising a movement case divided into upper and lower elongated case sections, a stator disposed between the upper an lower case sections, a rotor driven by the stator, a first reduction wheel operatively engaged by the rotor and a time indicating gear train for rotatably driving time indicator hands, the whole gear train being supported between the upper and lower case sections in a line and located within the height of the rotor.

In accordance with the present invention, further, the movement can easily be subjected to an automatic assembly since the stator, rotor and gear train are arranged in a line and completely disposed between the upper and lower case sections.

The present invention further provides a clock movement comprising a synchronous motor section, a clock gear train section basically arranged relative to the synchronous motor section in a line, time indicator hands adapted to be mounted on the movement at or near the distal end thereof, and battery means arranged on the opposite side of the stator relative to the wheel train.

The clock movement also comprises a stator of longitudinally extending C-shaped configuration and having a pair of parallel legs, a stator coil wound about one of the stator legs, a central stator axis extending between the parallel legs, a rotor disposed on the central stator axis, and a first reduction wheel located on the central stator axis. Thus, the clock movement can be small-sized and yet provide a sufficiently large drive power.

The time gear train section includes a time indicating gear train arranged in a straight line extending along the central stator axis or a curved line contacting the central stator axis. The battery is disposed on the opposite side of the elongated stator relative to the gear train.

In accordance with the present invention, therefore, the elongated movement can completely be concealed within a hollow strut for supporting the time indicator hands, in contrast with the conventional movements of circular or square configuration in which the parts are collected and mounted about the time indication shaft. Since the movement of the present invention is of a small-sized, but yet provides an increased drive force, the time indicator shaft on which the long and large hands are mounted cannot externally be viewed to have its driving mechanism located within the shaft itself. Thus, there can be provided a unique design as if its time indicator hands are rotated without any drive mechanism.

Since the battery is arranged on the opposite side of the stator relative to the gear train, a rotor producing a strong magnetic force is farther separated from the battery through the elongated stator even in a small-sized clock movement, so that the aforementioned inclination can positively be prevented in the rotor.

The present invention further provides a clock movement comprising an analog display section and a drive section which are separated from each other, the analog display section being reduced in size as possible and adapted to drive time indicator hands, the drive section including a battery and a motor drive circuit and electrically connected with the analog display section through a flexible wiring section such as lead wires or a flexible printed substrate. As a result, the drive and analog display sections may individually be mounted, for example, within separate clock struts. Thus, the analog display section for driving the time indicating hands can very be reduced in size.

In accordance with the present invention, therefore, the analog display section is effectively separated from the drive section such that the respective sections can be mounted separately within two different parts of the clock. The analog display and drive sections are electrically connected with each other through the flexible wiring section. As a result, the clock can highly be reduced in size. In the analog display section of the present invention, the elongated movement can completely be concealed within a hollow strut for supporting the time indicator hands, in contrast with the conventional movements of circular or square configuration in which the parts are collected and mounted about the time indication shaft. Since the movement of the present invention is of a small-sized, but yet provides an increased drive force, the time indicator shaft on which the long and large hands are mounted cannot externally be viewed to have its driving mechanism located within the shaft itself. Thus, there can be provided a unique design as if its time indicator hands are rotated without any drive mechanism.

The present invention further provides a clock movement comprising an analog display section and a drive section, these sections being separately formed and very simply locked against each other through pawl-groove type locking means in a releasable manner. When the analog display section is locked relative to the drive section, an electrical connection can automatically be established between the substrates of the display and drive sections.

In such an arrangement, any one of various different types of analog display sections may selectively be combined with any one of various different types of drive sections.

DETAILED DESCRIPTION OF PREFERRED EMBODIMENTS

The present invention will now be described, by way of example, with reference to the accompanying drawings.

Figure 1:
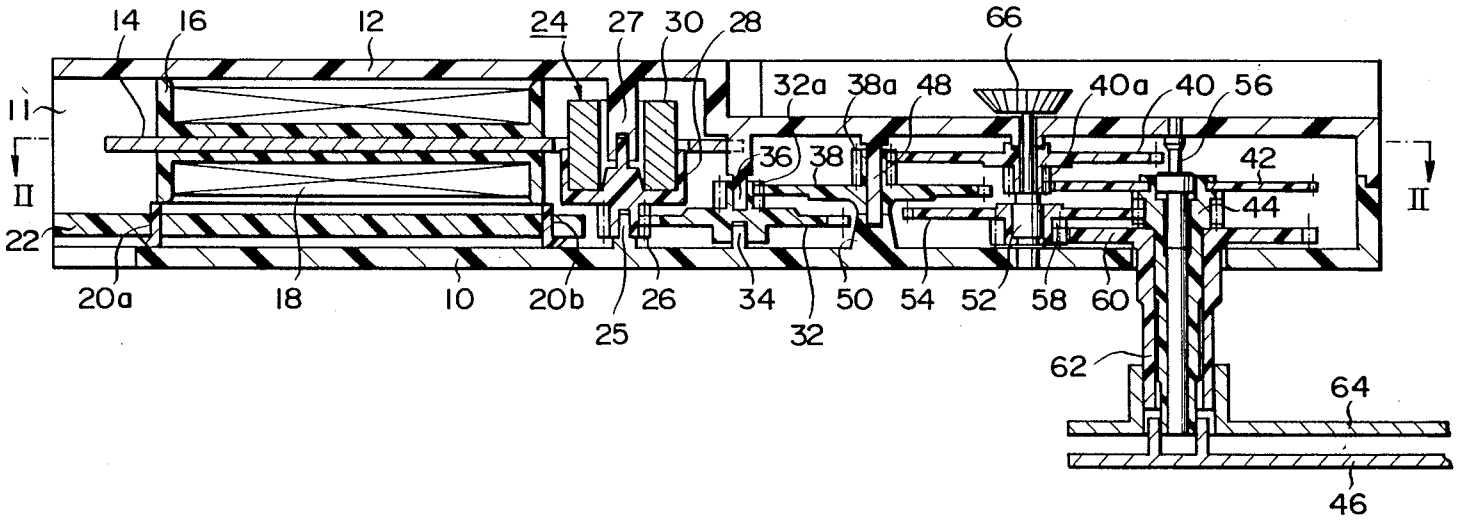
FIG. 1 is a longitudinally sectional view of a preferred embodiment of a timepiece or lock movement constructed according to the present invention.
Figure 2:
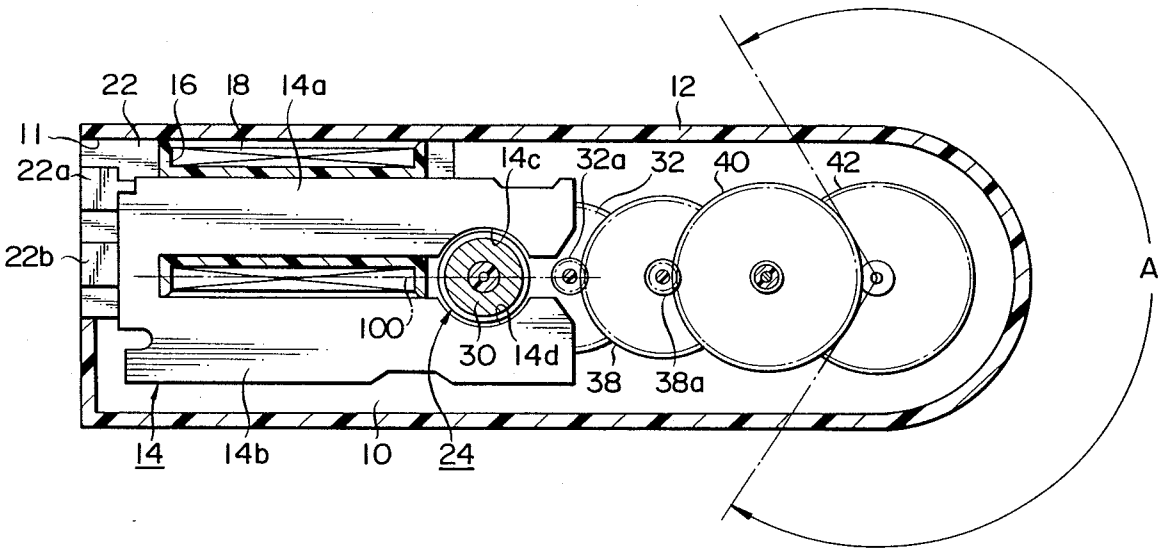
FIG. 2 is a cross-sectional view of the movement shown in FIG. 1, taken along a line II—II therein.

Referring now to FIGS. 1 and 2, there is shown a first preferred embodiment of a clock movement according to the present invention, which comprises a synchronous motor section, a clock gear train and a case divided into lower and upper case portions 10 and 12 between which the synchronous motor and time wheel train sections are housed and disposed.

As seen from FIG. 2, each of the lower and upper case portions 10, 12 is of an elongated configuration and has a longitudinal axis aligned with a central stator axis 100 which will be described. The clock gear train are arranged in a line on the extension of said central stator axis 100.

Between the case portions 10 and 12 is located the synchronous motor section in the left-hand half of the case as viewed in FIG. 1. The synchronous motor section includes a stator 14 which is of a longitudinally extending C-shaped configuration and made of a material having high magnetic permeability. The stator 14 includes a pair of legs **14*a* and 14*b* extending parallel to each other. The central stator axis 100 extends between these legs 14*a* and 14*b* and is positioned to align with the longitudinal axis of the case portions 10 and 12**.

One of the legs **14*a* in the stator 14 includes a bobbin 16 fixedly fitted thereover and a stator coil 18 wound about the bobbin 16. As be well-known in the art, the stator coil 18** receives synchronous driving pulses of a frequency normally equal to one Hz from a clock drive circuit (not shown) to create a magnetic flux required to drive the motor.

In the illustrated embodiment, each of the legs of the stator 14 has a sufficiently large length. Since the stator coil 18 is wound around the one leg **14*a* fully along the length thereof, the stator coil 18 has a sufficient number of windings. Thus, the stator 14 can produce a sufficient large magnitude of magnetic flux in comparison with the size of the clock movement according to the present invention. The stator 14** can provide a driving force sufficient to drive time indicating hands having their lengths longer than those of the conventional clocks.

The bobbin 16 includes a pair of engagement pawls **20*a* and 20*b* molded integrally therein. When the engagement pawls 20*a* and 20*b* engage a terminal plate 22, the stator 14 and the stator coil 18 are firmly held against the terminal plate 22. The terminal plate 22 is in turn secured rigidly in place between the case portions 10 and 12 by the fact that the distal ends of the engagement pawls 20*a* and 20*b* and one end of the bobbin 16 engage the inner walls of the case portions 10 and 12**.

As seen from FIG. 2, the terminal plate 22 includes at least two terminals **22*a* and 22*b* formed therein at one end. On assembling, the terminals 22*a* and 22*b* are externally exposed through an opening 11 formed between the case portions 10 and 12. Thus, any other motor drive circuit or power supply can electrically be connected with the stator 14** easily by the use of any simple connector.

Each of the legs **14*a* and 14*b* in the stator 14 includes a stator pole 14*c* or 14*d*** formed therein, which is in the form of a semi-circular recess as shown in FIG. 2.

A rotor 24 is disposed between the stator poles **14*c* and 14*d*. The rotor 24 includes a rotor pinion 26, a magnet receiver 28 formed integrally on the rotor pinion 26 and a rotor magnet 30 received in and fixed to the magnet receiver 28. The rotor pinion 26 and the magnet receiver 28 are rotatably supported between the case portions 10 and 12 in a manner which will be described. Thus, the rotor magnet 30 magnetized into any number of magnetic poles can be rotated between the stator poles 14*c* and 14*d*. In the illustrated embodiment, he rotor 24 is rotatably supported by a stub 25 extending upwardly from the inner wall of the lower case portion 10 and a shaft-like bearing 27 extending downwardly from the inner wall of the upper case portion 12. When the stator coil 18 on the stator 14 receives a given pulse signal, a magnetic flux will be created in the stator poles 14*c* and 14*d* to drive the rotor 24** electromagnetically.

In the illustrated rotor 24, the rotor magnet 30 has a relatively large height to create an electromagnetic power effectively between the stator poles **14*c* and 14*d*. The rotor 24 with the rotor pinion 26 combined therewith provides an important factor limiting the thickness of the movement case which consists of the lower and upper case portions 10, 12. As will be described, the present invention is characterized by that the first reduction gear wheel engaging the rotor pinion 26 and the time indicating gear train are completely received within the height of the rotor 24** to minimize the thickness of the clock movement case.

In such a manner, a synchronous motor section is formed between the case portions 10 and 12 so that the rotor 24 can be rotated in the normal intermittent feed manner or in the continuous feed manner if required. The rotation of the rotor 24 is transmitted to time indicating hands through the clock gear train.

The clock gear train may be divided into the first reduction wheel engaging the rotor pinion 26 of the rotor 24 and a time indicating gear train for transmitting the rotation from the first reduction wheel to the time indicating hands. At least the first reduction wheel is positioned on the central stator axis 100.

The first reduction wheel 32 is rotatably supported by a stub 34 extending upwardly from the inner wall of the lower case portion 10 and another stub 36 extending downwardly from the inner wall of the upper case portion 12. The first reduction wheel 32 includes a reduction pinion **32*a*** formed integrally thereon which in turn is operatively connected with the time indicating gear train which will be described in more details.

As seen from FIG. 2, the first reduction wheel 32 is located on the central stator axis 100. In addition, the central stator axis is positioned in an opening formed between the legs **14*a* and 14*b* of the stator 14 while the reduction pinion 32*a* is disposed at a position facing the distal opened end formed between the stator poles 14*c* and 14*d*. Therefore, neither of the stator leg 14*a* or 14*b* will have a through bore for rotatably receiving the first reduction wheel 32**. This can make the clock movement compact.

The first reduction pinion **32*a* further engages a fourth wheel 38 including a fourth wheel pinion 38*a* which in turn engages a third wheel 40. The third wheel 40 has a third wheel pinion 40*a* engaging a center wheel 42. A center wheel pinion 44 is slidably fitted onto the center wheel 42 under the action of a given frictional force. A minute hand 46 is fixedly fitted over the center wheel pinion 44**.

The fourth wheel 38 is provided with a central bore through which a shaft 48 extends from the upper case portion 12 to support the fourth wheel 38. The shaft 48 engages in a bearing 50 extending upwardly from the inner wall of the lower case portion 10.

On the other hand, the third wheel 40 is rotatably supported by a minute wheel shaft 52 journalled by the case portions 10 and 12. The minute wheel shaft 52 rigidly supports a minute wheel 54 which will be described.

The center wheel and pinion 42, 44 are rotatably supported by a center wheel pipe receiver 56 which is fixedly mounted in the upper case portion 12.

The center wheel pinion 44 engages the minute wheel 54 having a minute wheel pinion 58 which in turn engages a hour hand wheel 60 rotatably supported by the center wheel pinion 44. A hour hand shaft 62 is formed integrally on the hour hand wheel 60 and fixedly supports a hour hand 62.

As described, the time indicating gear train includes the fourth wheel 38 engaging the first reduction wheel 32, the third wheel 40, the center wheel 42, the minute wheel 54 and the hour hand wheel 60 which are subsequently connected with the preceding one. In the first illustrated embodiment, the time indicating gear train is completely disposed on the extension of the central stator axis 100.

In such an arrangement, the rotational drive power can positively be transmitted from the rotor 24 through the first reduction wheel 32 via said time indicating gear train to the hour and minute hands 64, 46.

In accordance with the present invention, the first reduction wheel 32 and the time indicating gear train associated therewith are operatively supported between the upper and lower case portions 12, 10 in a line, in contrast with the conventional design requiring an intermediate plate and others. It is therefore impossible to create any misalignment of wheel shaft on assembling. Thus, the assembling can easily be automated while maintainig the wheel shafts very stably.

In addition, the gear train is completely positioned at a level lower than the height of the rotor, so that the thickness of the movement case can be minimized in compatibility with the height of the rotor.

In the first embodiment, a time correction knob 66 is fixedly mounted on the minute wheel shaft 52 on the side of the upper case portion 12. When the knob 66 is rotated, the minute wheel and pinion 54, 58 are rotated to rotatably drive the center wheel pinion 44 and the hour hand wheel 60 into any desired correct position. At such a time, slippage is created between the center wheel pinion 44 and the center wheel 42 through any suitable slipping mechanism so that the synchronous motor section will not adversely be affected.

In accordance with the present invention, thus, the synchronous motor section includes the longitudinally extending C-shaped stator, the latter including its central axis on which at least the rotor and first reduction wheel in the synchronous motor section are positioned, and the time indicating gear trains disposed in a line on the extension of the central stator axis. This results in an elongated movement having its whole reduced size. Longer time indicating hands can rotatably be driven by a larger drive power from the synchronous motor section. The elongated movement can contributes to the increased flexibility on designing the external appearance of clocks. Particularly, the elongated movement is very advantageous for concealed movement type clocks.

The present invention is further characterized by that the minute and hour hands 46 and 64 are rigidly connected on the forwardmost end of the time indicating gear train, that is, the respective one of the center and hour-hand wheels 42, 60. By such a fact that the time indicating hands are fixedly connected with the time indicating gear train, no other gear train or movement part will be arranged about the time indicating shaft. There is thus a very available space through a segment shown by A in FIG. 2. In accordance with the present invention, such a space may extend through an angle more than 200°. This can very increase the flexibility on clock design.

Figure 3:
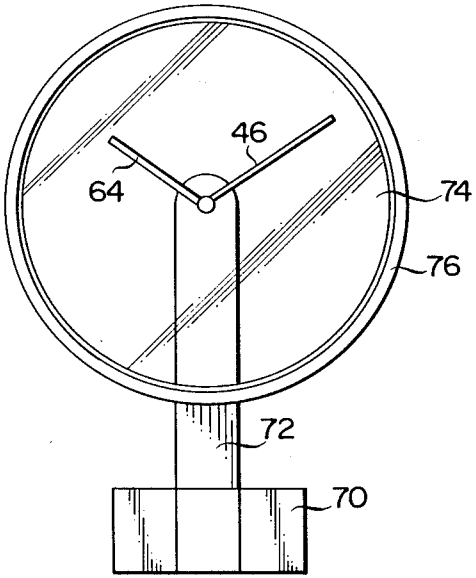
FIG. 3 is a front elevational view of the first embodiment during service.

FIG. 3 shows a table clock to which the present invention is applied. This table clock comprises a base 70, a support column 72 fixedly mounted on the base 70 and an indicator plate 74. In the illustrated construction, the indicator plate 74 is a transparent disc framed by a frame 76.

The clock movement according to the present invention is completely housed within the strut 72, the top potion of which supports the hour and minute hands 64, 46.

Such an arrangement provides a very unique appearance to the clock, which if one views this clock, he cannot find the clock movement since it appears to him that the time indicating hands are substantially surrounded by the transparent plate with only the strut 73 supporting the time indicating hands.

Figure 4:
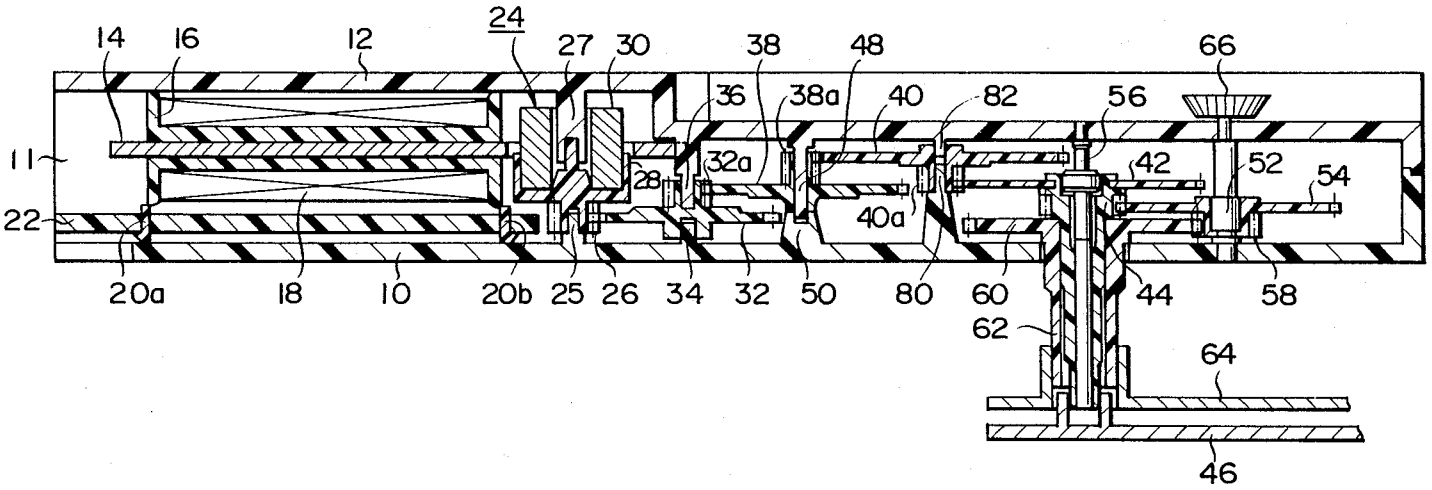
FIG. 4 is a longitudinally sectional view of a second preferred embodiment of a timepiece or clock movement constructed according to the present invention.

FIG. 4 shows a second embodiment of the present invention in which parts similar to those of FIG. 1 are denoted by similar reference numerals with a further description thereon being omitted.

The second embodiment is characterized by that the clock gear train includes center and hour-hand wheels 42, 60 of the time indicating gear train and a minute wheel 54 arrange in a manner different from that of the first embodiment. Thus, hour and minute hands 64, 46 are positioned closer to a synchronous motor.

In the second embodiment, a third wheel 40 is rotatably supported by a stub 80 extending upwardly from the inner wall of a lower case portion 10 and a stub 82 extending downwardly from the inner wall of an upper case portion 12.

As described, the first embodiment of the present invention includes the time indicating shaft disposed at the outermost periphery of the clock movement such that the available space about the time indicating shaft will be increased as possible, as shown in FIG. 3. In the second embodiment, however, such an advantage is sacrificed to provide another advantage in that the time indicating shaft can be displaced toward the center of the length of the clock movement.

Figure 5:
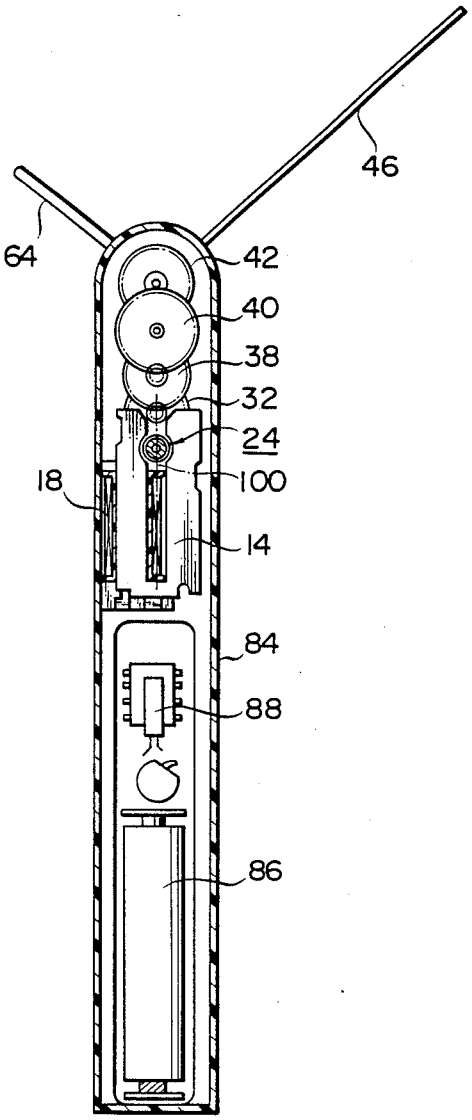
FIG. 5 is a view, partially broken away, of another preferred embodiment of the present invention.
Figure 6:
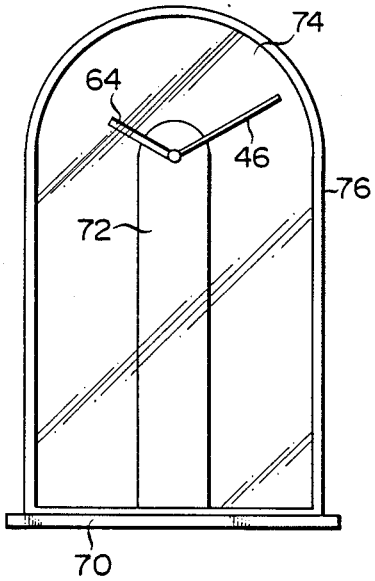
FIG. 6 is a front elevational view of a clock to which the third embodiment shown in FIG. 5 is applied.

Referring now to FIG. 5, there is shown another embodiment of the present invention in which a clock movement includes a battery and a drive control circuit, all of which are completely housed within the interior of the clock movement. As shown in FIG. 5, a case 84 contains a battery and drive control circuit 86, 88 disposed on the extension of the central stator axis 100. Thus, all the parts required by the elongated movement can be assembled thereinto. As shown in FIG. 6, for example, a clock movement including said battery and circuit can be incorporated into the interior of a strut 72 which is fixedly mounted on a base 70. In such an arrangement, a decorative plate 74 made of a transparent sheet material can be used to provide a concealed movement type clock in which the whole drive mechanism is completely concealed by the strut 72.

Although the aforementioned embodiments of the present invention have been described as to the time indicating gear train disposed on the extension of the central stator axis, the present invention may be embodied to provide a time indicating gear train arranged on a line curved or turned along the central stator axis.

Figure 7:
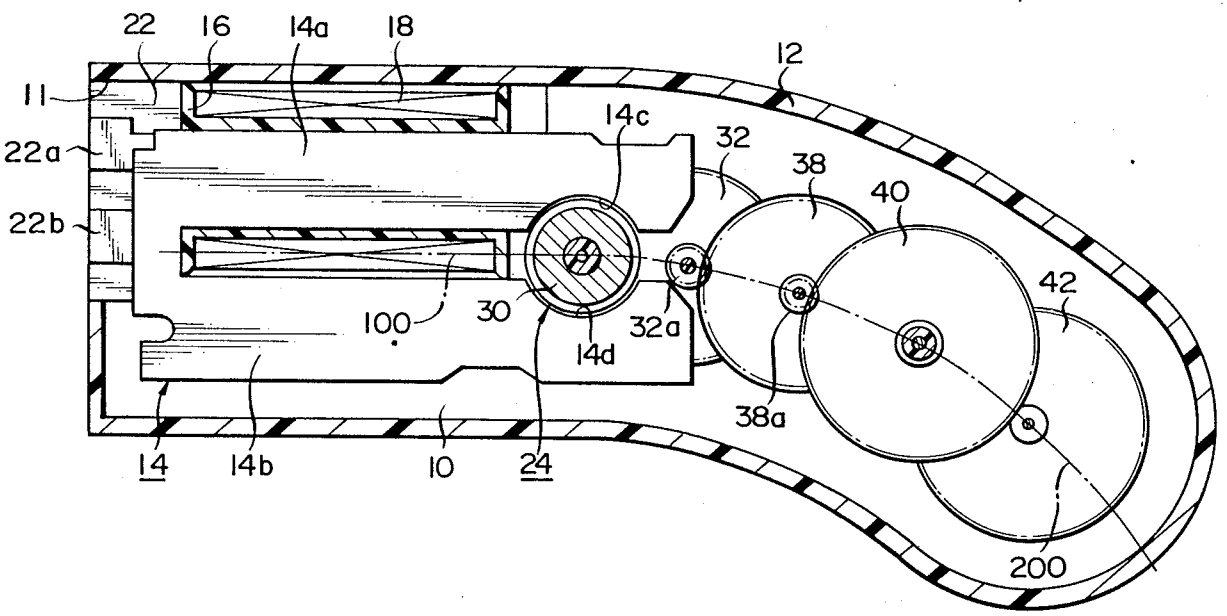
FIG. 7 is a plan view, partially broken away, of still another embodiment of the present invention in which a clock gear train is disposed on a curved line.

FIG. 7 shows still another embodiment of the present invention in which a time indicating gear train is disposed on a curved line. This embodiment is constructed of components substantially similar to those of FIG. 2. Therefore, similar parts are denoted by similar reference numerals and a further description thereon will be omitted.

In FIG. 7, a first reduction wheel 32 and a time indicating gear train (38, 40 and 42) engaging the wheel 32 are arranged along an arcuate or curved line 200 contacting the central stator axis 100. As a result, case portions 12 and 10 also are of a curved outline corresponding to said arcuate line 200.

A clock movement of such a curved configuration can be applied to a clock having a unique design in which a curved strut supports time indicating hands at its forwardmost end.

As will be apparent from the foregoing, the present invention provides a unique clock design which comprises an elongated clock movement including a synchronous motor section and a clock gear train, the elongated clock movement serving as a clock drive incorporated into the clock and concealed as possible.

Figure 8:
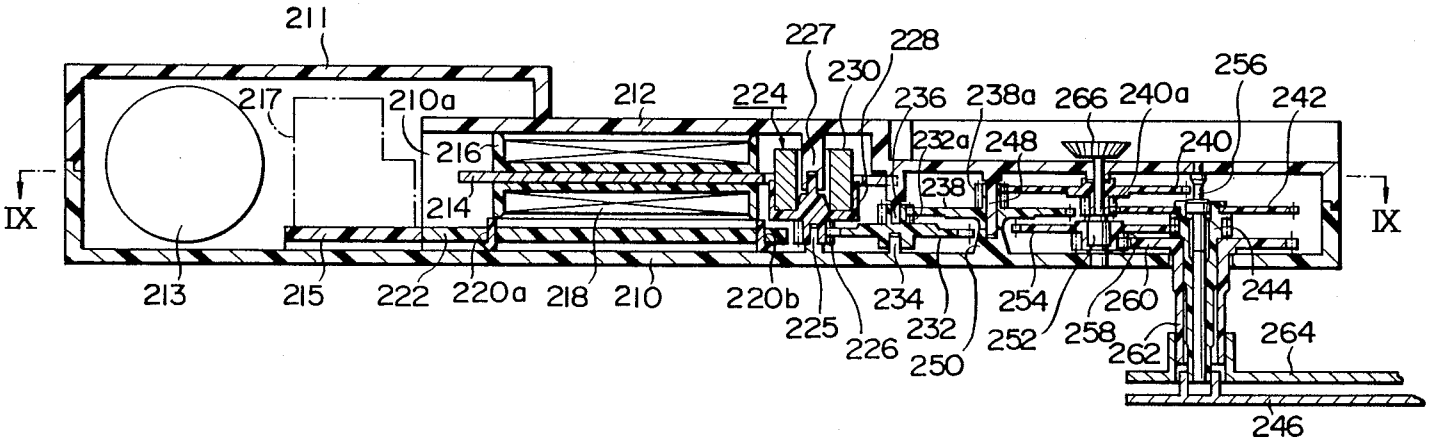
FIG. 8 is a longitudinally sectional view of a third preferred embodiment of a timepiece movement constructed according to the present invention.
Figure 9:
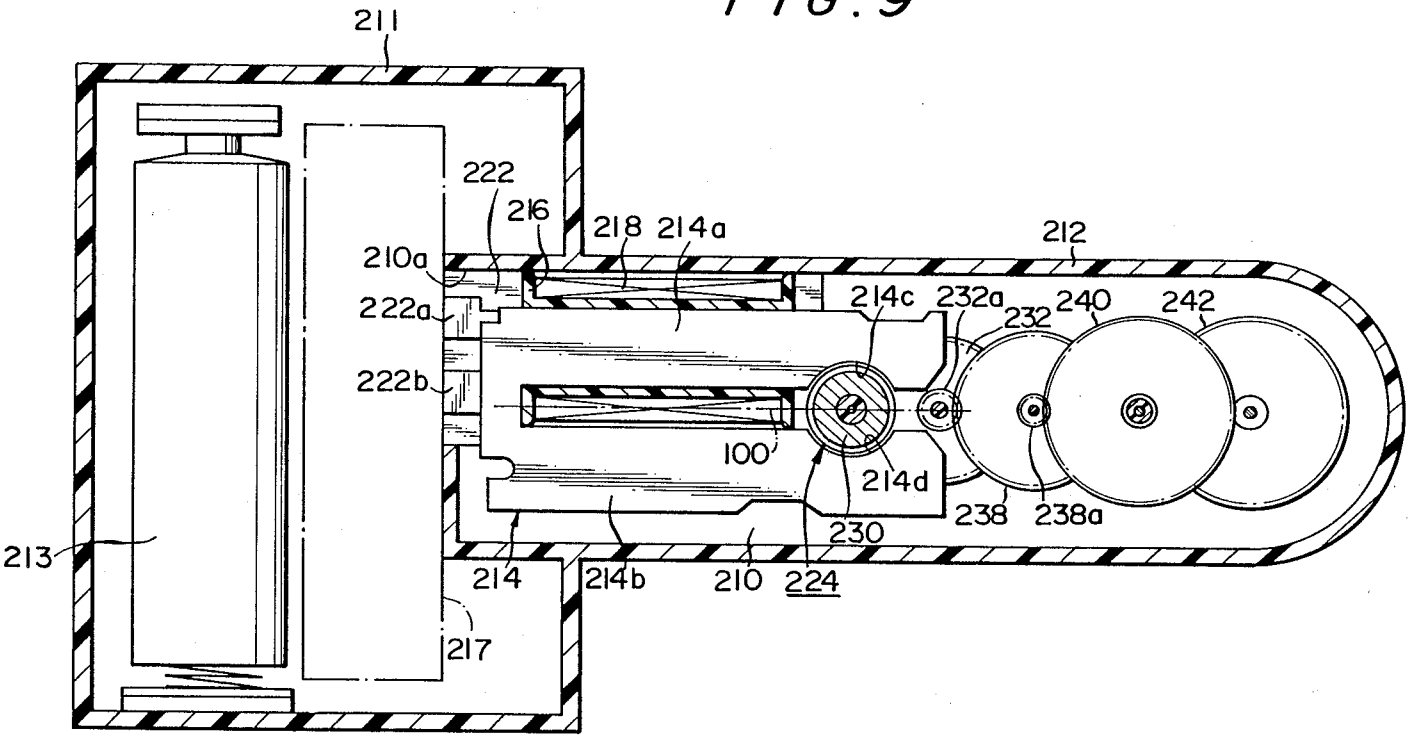
FIG. 9 is a cross-sectional view of the clock movement shown in FIG. 8, taken along a line IX—IX therein.

Referring now to FIGS. 8 and 9, there is shown a third preferred embodiment of a clock movement according to the present invention, which comprises a synchronous motor section, a clock gear train and a case divided into lower and upper case portions 210 and 212 between which the synchronous motor and time wheel train sections are housed and disposed.

As seen from FIG. 9, each of the lower and upper case portions 210, 212 is of an elongated configuration and has a longitudinal axis aligned with a central stator axis 100 which will be described. The clock gear train are arranged in a line on the extension of said central stator axis 100.

Between the case portions 210 and 212 is located the synchronous motor section in the left-hand half of the case as viewed in FIG. 8. The synchronous motor section includes a stator 214 which is of a longitudinally extending C-shaped configuration and made of a material having high magnetic permeability. The stator 14 includes a pair of legs **214*a* and 214*b* extending parallel to each other. The central stator axis 100 extends between these legs 214*a* and 214*b* and is positioned to align with the longitudinal axis of the case portions 210 and 212**.

One of the legs **214*a* in the stator 214 includes a bobbin 216 fixedly fitted thereover and a stator coil 218 wound about the bobbin 216. As be well-known in the art, the stator coil 218** receives synchronous driving pulses of a frequency normally equal to one Hz from a clock drive circuit (not shown) to create amagnetic flux required to drive the motor.

In the illustrated embodiment, each of the legs of the stator 214 has a sufficiently large length. Since the stator coil 218 is wound around the one leg **214*a* fully along the length thereof, the stator coil 218 has a sufficient number of windings. Thus, the stator 214 can produce a sufficient large magnitude of magnetic flux in comparison with the size of the clock movement according to the present invention. The stator 214** can provide a driving force sufficient to drive time indicating hands having their lengths longer than those of the conventional clocks.

The bobbin 216 includes a pair of engagement pawls **220*a* and 220*b* molded integrally therein. When the engagement pawls 220*a* and 220*b* engage a terminal plate 222, the stator 214 and the stator coil 218 are firmly held against the terminal plate 222. The terminal plate 222 is in turn secured rigidly in place between the case portions 210 and 212 by the fact that the distal ends of the engagement pawls 220*a* and 220*b* and one end of the bobbin 216 engage the inner walls of the case portions 210 and 212**.

As seen from FIG. 9, the terminal plate 222 includes at least two terminals **222*a* and 222*b* formed therein at one end. On assembling, the terminals 222*a* and 222*b* are externally exposed through an opening 210*a* formed between the case portions 210 and 212. Thus, any other motor drive circuit or power supply can electrically be connected with the stator 14** easily by the use of any simple connector.

Each of the legs 214*a* and 214*b* in the stator 214 includes a stator pole 214*c* or 214*d* formed therein, which is in the form of a semi-circular recess as shown in FIG. 9.

A rotor 224 is disposed between the stator poles 214*c* and 214*d*. The rotor 224 includes a rotor pinion 226, a magnet receiver 228 formed integrally on the rotor pinion 226 and a rotor magnet 230 received in and fixed to the magnet receiver 228. The rotor pinion 226 and the magnet receiver 228 are rotatably supported between the case portions 210 and 212 in a manner which will be described. Thus, the rotor magnet 230 magnetized into any number of magnetic poles can be rotated between the stator poles 214*c* and 214*d*. In the illustrated embodiment, the rotor 224 is rotatably supported by a stub 225 extending upwardly from the inner wall of the lower case portion 210 and a shaft-like bearing 227 extending downwardly from the inner wall of the upper case portion 212. When the stator coil 218 on the stator 214 receives a given pulse signal, a magnetic flux will be created in the stator poles 214*c* and 214*d* to drive the rotor 224 electromagnetically.

In such a manner, a synchronous motor section is formed between the case portions 210 and 212 so that the rotor 224 can be rotated in the normal intermittent feed manner or in the continuous feed manner if required. The rotation of the rotor 224 is transmitted to time indicating hands through the clock gear train.

The clock gear train may be divided into the first reduction wheel engaging the rotor pinion 226 of the rotor 224 and a time indicating gear train for transmitting the rotation from the first reduction wheel to the time indicating hands. At least the first reduction wheel is positioned on the central stator axis 100.

The first reduction wheel 232 is rotatably supported by a stub 234 extending upwardly from the inner wall of the lower case portion 210 and another stub 236 extending downwardly from the inner wall of the upper case portion 212. The first reduction wheel 232 includes a reduction pinion 232*a* formed integrally thereon which in turn is operatively connected with the time indicating gear train which will be described in more details.

As seen from FIG. 9, the first reduction wheel 232 is located on the central stator axis 100. In addition, the central stator axis is positioned in an opening formed between the legs 214*a* and 214*b* of the stator 214 while the reduction pinion 232*a* is disposed at a position facing the distal opened end formed between the stator poles 214*c* and 214*d*. Therefore, neither of the stator leg 214*a* or 214*b* will have a through bore for rotatably receiving the first reduction wheel 232. This can make the clock movement compact.

The first reduction pinion 232*a* further engages a fourth wheel 238 including a fourth wheel pinion 238*a* which in turn engages a third wheel 240. The third wheel 240 has a third wheel pinion 240*a* engaging a center wheel 242. A center wheel pinion 244 is slidably fitted onto the center wheel 242 under the action of a given frictional force. A minute hand 246 is fixedly fitted over the center wheel pinion 244.

The fourth wheel 238 is provided with a central bore through which a shaft 248 extends from the upper case portion 212 to support the fourth wheel 238. The shaft 248 engages in a bearing 250 extending upwardly from the inner wall of the lower case portion 210.

On the other hand, the third wheel 240 is rotatably supported by a minute wheel shaft 252 journalled by the case portions 210 and 212. The minute wheel shaft 252 rigidly supports a minute wheel 254 which will be described.

The center wheel and pinion 242, 244 are rotatably supported by a center wheel pipe receiver 256 which is fixedly mounted in the upper case portion 212.

The center wheel pinion 244 engages the minute wheel 254 having a minute wheel pinion 258 which in turn engages a hour hand wheel 260 rotatably supported by the center wheel pinion 244. A hour hand shaft 262 is formed integrally on the hour hand wheel 260 and fixedly supports a hour hand 262.

As described, the time indicating gear train includes the fourth wheel 238 engaging the first reduction wheel 232, the third wheel 240, the center wheel 242, the minute wheel 254 and the hour hand wheel 260 which are subsequently connected with the preceding one. In the first illustrated embodiment, the time indicating gear train is completely disposed on the extension of the central stator axis 100.

In such an arrangement, the rotational drive power can positively be transmitted from the rotor 224 through the first reduction wheel 232 via said time indicating gear train to the hour and minute hands 264, 246.

In the third embodiment, a time correction knob 266 is fixedly mounted on the minute wheel shaft 252 on the side of the upper case portion 212. When the knob 266 is rotated, the minute wheel and pinion 254, 258 are rotated to rotatably drive the center wheel pinion 244 and the hour hand wheel 260 into any desired correct position. At such a time, slippage is created between the center wheel pinion 244 and the center wheel 242 through any suitable slipping mechanism so that the synchronous motor section will not adversely be affected.

In accordance with the present invention, thus, the synchronous motor section includes the longitudinally extending C-shaped stator, the latter including its central axis on which at least the rotor and first reduction wheel in the synchronous motor section are positioned, and the time indicating gear trains disposed in a line on the extension of the central stator axis. This results in an elongated movement having its whole reduced size. Longer time indicating hands can rotatably be driven by a larger drive power from the synchronous motor section. The elongated movement can contributes to the increased flexibility on designing the external appearance of clocks. Particularly, the elongated movement is very advantageous for concealed movement type clocks.

In accordance with the present invention, a removable battery lid 211 also is mounted in the lower case portion 210 at the left-hand half thereof as viewed in FIGS. 8 and 9. The battery lid 211 receives a battery 213 and a motor drive circuit 217 fixedly mounted on a circuit substrate 215.

The battery 13 is thus arranged on the opposite side of the stator 214 relative to the gear train and particularly the rotor 224 and in a direction perpendicular to the orientation of the gear train. The stator 214 is of an elongated C-shape, one end of which receives the rotor 224. On the extension of the other end of the stator 214 is located the battery 213 which is sufficiently separated from the rotor as seen from FIGS. 8 and 9. Even when a magnetic flux in the rotor 224 is increased, any magnetic affection will positively be prevented from creating between the battery 213 and the rotor 224.

In such a manner, the magnetic flux in the rotor 224 can be increased to provide a small-sized clock movement having an increased drive power without any inclination of the rotor 224 relative to the battery 213 and so on.

Figure 10:
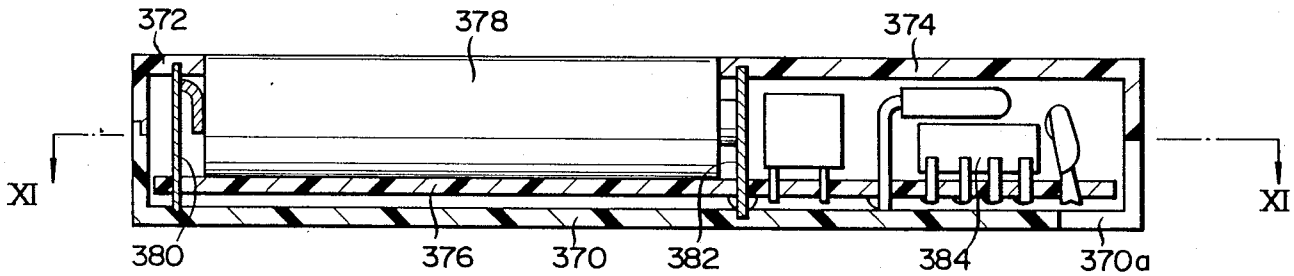
FIG. 10 is a longitudinally sectional view of a preferred embodiment of a drive section in a timepiece movement according to the present invention.
Figure 11:
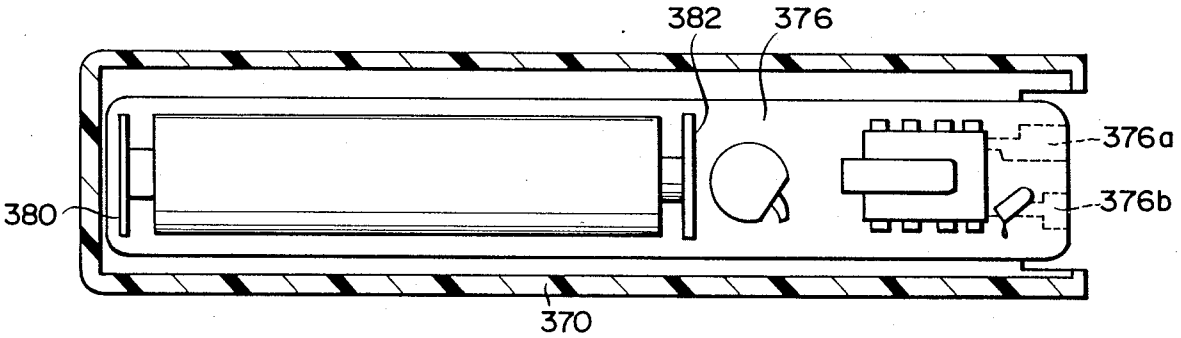
FIG. 11 is a cross-sectional view of the movement shown in FIG. 10, taken along a line XI—XI therein.

FIGS. 10 and 11 show a further preferred embodiment of the present invention in which a drive section is formed separately from said analog display section.

The drive section includes a lower case portion 370, an electromagnetic lid 372 removably mounted on the lower case portion 370 and an upper case portion 374 detachably mounted on the lower case portion 370. The lower case portion 370 rigidly receives a drive circuit substrate 376.

The lower case portion 370 has an elongated configuration similar to those of the lower and upper case portions 10, 12 in the analog display section. A battery 378 is mounted longitudinally within the interior of the lower case portion 370.

In order to hold the battery 378, the drive circuit substrate 376 includes terminal tabs 380 and 382 rigidly mounted thereon. As be well-known in the art, the battery 378 is held between the terminal tabs 380 and 382.

As shown, the drive circuit substrate 376 also includes a drive circuit printed thereon, the drive circuit including a motor drive IC 384. The drive circuit substrate 376 is formed at one end with terminals **376*a* and 376*b* which can easily receive leads through an opening 370*a* formed between the case portions 370 and 374**.

By soldering the lead wires or FPC's to the exposed terminals, the drive section shown in FIGS. 10 and 11 can very easily be connected electrically with the analog display section shown in FIGS. 1 and 2 while maintaining the respective sections at any separated locations.

Figure 12:
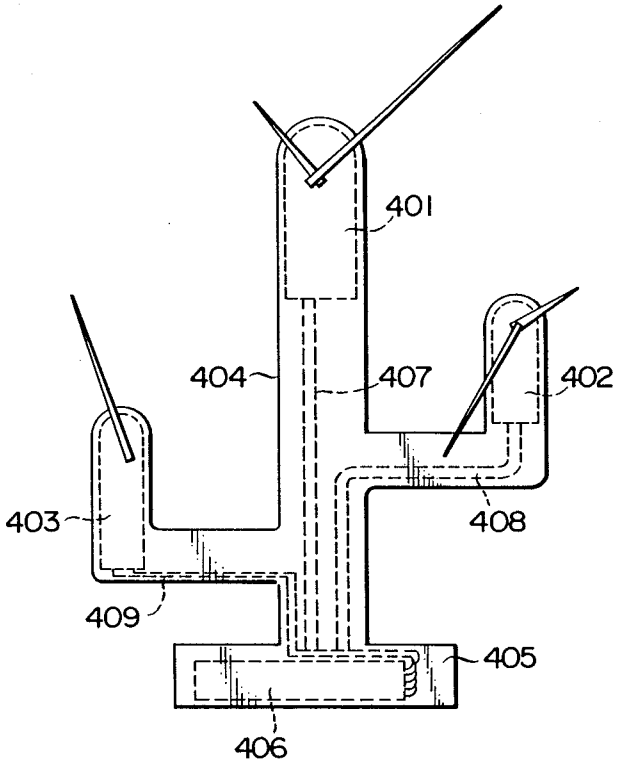
FIG. 12 is a front elevational view of a clock to which timepiece movements of the present invention are applied.

FIG. 12 shows a further embodiment of the present invention in which a plurality of analog display sections as aforementioned can be driven by a single drive section. Three analog display sections 401, 402 and 403, which are identical with the analog display section shown in FIGS. 1 and 2, are adapted to display times in a plurality of countries which have time differentials.

In accordance with the present invention, each of these three analog display sections 401, 402 and 403 can very be miniaturized as described and easily be housed within the interior of an outer case 404.

The analog display sections 401, 402 and 403 are simultaneously driven by a drive section 406 completely mounted within a base 405. The drive section 406 has the same construction as shown in FIGS. 10 and 11.

In FIG. 12, the drive section 406 is electrically connected with the respective analog display sections through flexible wirings, for example, through lead lines 407, 408 and 409 in the illustrated embodiment. Therefore, the analog display sections 401, 402 and 403 can be arranged at any locations separated from one another and from the drive section 406.

As will be apparent from the foregoing, the present invention can provide a concealed movement type clock having an increased flexibility of design, which comprises an analog display section including a synchronous motor section and a clock gear train and a drive section including a battery and a drive circuit, these sections being electrically connected with each other through flexible wiring and capable of being arranged at any separated locations, thereby being particularly able to decrease the size of the analog display section.

Since the analog display section and the drive section are separated from each other according to the present invention, a plurality of analog display sections can be driven by a single drive section. Otherwise, a plurality of drive sections having different capacities may be used to drive a plurality of analog display sections having hands of different lengths, respectively. Furthermore, the present invention can provide a unique clock design in which the clock drive section can be concealed as possible by providing an elongated clock movement including a synchronous motor section and a clock gear train.

Figure 13:
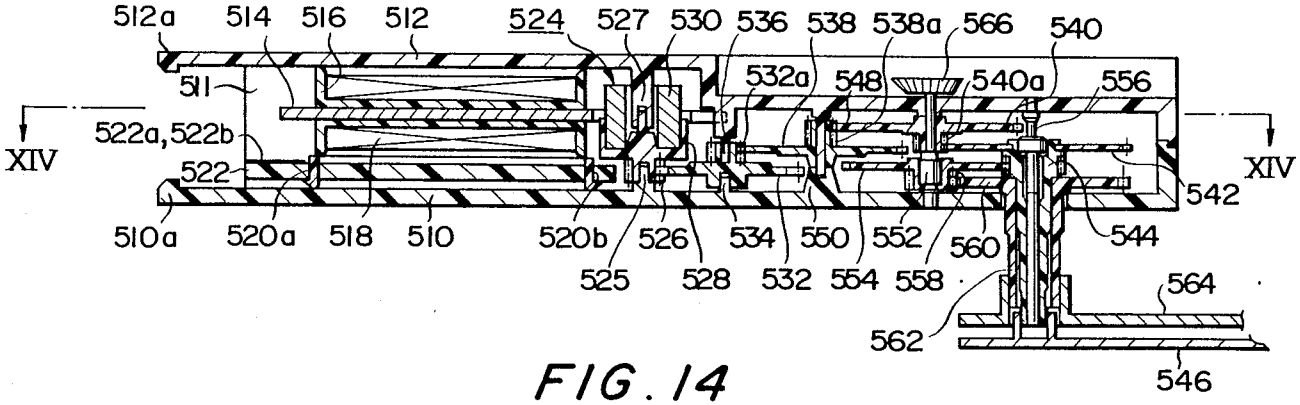
FIG. 13 is a longitudinally sectional view of a preferred embodiment of an analog display section in a timepiece movement constructed according to the present invention.
Figure 14:
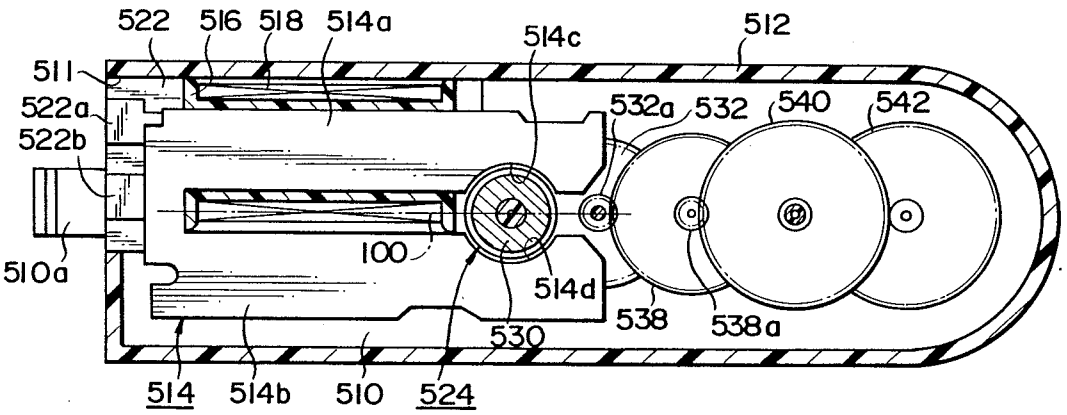
FIG. 14 is a cross-sectional view of the analog display section shown in FIG. 13, taken along a line XIV—XIV therein.

Referring now to FIGS. 13 and 14, there is shown a fourth preferred embodiment of a clock movement according to the present invention, which comprises a synchronous motor section, a clock gear train and a case divided into lower and upper case portions 510 and 512 between which the synchronous motor and time wheel train sections are housed and disposed.

As seen from FIG. 14, each of the lower and upper case portions 510, 512 is of an elongated configuration and has a longitudinal axis aligned with a central stator axis 100 which will be described. The clock gear train are arranged in a line on the extension of said central stator axis 100.

The fourth embodiment is characterized by that the movement case of said analog display section is provided with pawl means for releasably and mechanically connecting the movement case with a drive section as will be described. The pawl means includes pawl portions **510*a* and 512*a* extending from the respective left-hand ends of the case portions 510 and 512**.

The case portions 510 and 512 are molded of a plastic material. As a result, the pawl portions **510*a* and 512*a*** are flexible and can then be connected detachably with any drive section.

Between the case portions 510 and 512 is located the synchronous motor section in the left-hand half of the case as viewed in FIG. 13. The synchronous motor section includes a stator 514 which is of a longitudinally extending C-shaped configuration and made of a material having high magnetic permeability. The stator 514 includes a pair of legs **514*a* and 514*b* extending parallel to each other. The central stator axis 100 extends between these legs 514*a* and 514*b* and is positioned to align with the longitudinal axis of the case portions 510 and 512**.

One of the legs **514*a* in the stator 514 includes a bobbin 516 fixedly fitted thereover and a stator coil 518 wound about the bobbin 516. As be well-known in the art, the stator coil 518** receives synchronous driving pulses of a frequency normally equal to one Hz from a clock drive circuit (not shown) to create a magnetic flux required to drive the motor.

In the illustrated embodiment, each of the legs of the stator 514 has a sufficiently large length. Since the stator coil 518 is wound around the one leg **514*a* fully along the length thereof, the stator coil 518 has a sufficient number of windings. Thus, the stator 514 can produce a sufficient large magnitude of magnetic flux in comparison with the size of the clock movement according to the present invention. The stator 514** can provide a driving force sufficient to drive time indicating hands having their lengths longer than those of the conventional clocks.

The bobbin 516 includes a pair of engagement pawls 520*a* and 520*b* molded integrally therein. When the engagement pawls 520*a* and 520*b* engage a terminal plate 522, the stator 514 and the stator coil 518 are firmly held against the terminal plate 522. The terminal plate 522 is in turn secured rigidly in place between the case portions 510 and 512 by the fact that the distal ends of the engagement pawls 520*a* and 520*b* and one end of the bobbin 516 engage the inner walls of the case portions 510 and 512.

As seen from FIG. 14, the terminal plate 522 includes at least two terminals 522*a* and 522*b* formed therein at one end. On assembling, the terminals 522*a* and 522*b* are externally exposed through an opening 511 formed between the case portions 510 and 512. Thus, any other motor drive circuit or power supply can electrically be connected with the stator 514 easily by the use of any simple connector.

Each of the legs 514*a* and 514*b* in the stator 514 includes a stator pole 514*c* or 514*d* formed therein, which is in the form of a semi-circular recess as shown in FIG. 14.

A rotor 524 is disposed between the stator poles 514*c* and 514*d*. The rotor 524 includes a rotor pinion 526, a magnet receiver 528 formed integrally on the rotor pinion 526 and a rotor magnet 530 received in and fixed to the magnet receiver 528. The rotor pinion 526 and the magnet receiver 528 are rotatably supported between the case portions 510 and 512 in a manner which will be described. Thus, the rotor magnet 530 magnetized into any number of magnetic poles can be rotated between the stator poles 514*c* and 514*d*. In the illustrated embodiment, the rotor 524 is rotatably supported by a stub 525 extending upwardly from the inner wall of the lower case portion 510 and a shaft-like bearing 527 extending downwardly from the inner wall of the upper case portion 512. When the stator coil 518 on the stator 514 receives a given pulse signal, a magnetic flux will be created in the stator poles 514*c* and 514*d* to drive the rotor 524 electromagnetically.

In such a manner, a synchronous motor section is formed between the case portions 510 and 512 so that the rotor 524 can be rotated in the normal intermittent feed manner or in the continuous feed manner if required. The rotation of the rotor 524 is transmitted to time indicating hands through the clock gear train.

The clock gear train may be divided into the first reduction wheel engaging the rotor pinion 526 of the rotor 524 and a time indicating gear train for transmitting the rotation from the first reduction wheel to the time indicating hands. At least the first reduction wheel is positioned on the central stator axis 100.

The first reduction wheel 532 is rotatably supported by a stub 534 extending upwardly from the inner wall of the lower case portion 510 and another stub 536 extending downwardly from the inner wall of the upper case portion 512. The first reduction wheel 532 includes a reduction pinion 532*a* formed integrally thereon which in turn is operatively connected with the time indicating gear train which will be described in more details.

As seen from FIG. 14, the first reduction wheel 532 is located on the central stator axis 100. In addition, the central stator axis is positioned in an opening formed between the legs 514*a* and 514*b* of the stator 514 while the reduction pinion 532*a* is disposed at a position facing the distal opened end formed between the stator poles 514*c* and 514*d*. Therefore, neither of the stator leg 514*a* or 514*b* will have a through bore for rotatably receiving the first reduction wheel 532. This can make the clock movement compact.

The first reduction pinion 532*a* further engages a fourth wheel 538 including a fourth wheel pinion 538*a* which in turn engages a third wheel 540. The third wheel 540 has a third wheel pinion 540*a* engaging a center wheel 542. A center wheel pinion 544 is slidably fitted onto the center wheel 542 under the action of a given frictional force. A minute hand 546 is fixedly fitted over the center wheel pinion 544.

The fourth wheel 538 is provided with a central bore through which a shaft 548 extends from the upper case portion 512 to support the fourth wheel 538. The shaft 548 engages in a bearing 550 extending upwardly from the inner wall of the lower case portion 510.

On the other hand, the third wheel 540 is rotatably supported by a minute wheel shaft 552 journalled by the case portions 510 and 512. The minute wheel shaft 552 rigidly supports a minute wheel 554 which will be described.

The center wheel and pinion 542, 544 are rotatably supported by a center wheel pipe receiver 556 which is fixedly mounted in the upper case portion 512.

The center wheel pinion 544 engages the minute wheel 554 having a minute wheel pinion 558 which in turn engages a hour hand wheel 560 rotatably supported by the center wheel pinion 544. A hour hand shaft 562 is formed integrally on the hour hand wheel 560 and fixedly supports a hour hand 562.

As described, the time indicating gear train includes the fourth wheel 538 engaging the first reduction wheel 532, the third wheel 540, the center wheel 542, the minute wheel 554 and the hour hand wheel 560 which are subsequently connected with the preceding one. In the first illustrated embodiment, the time indicating gear train is completely disposed on the extension of the central stator axis 100.

In such an arrangement, the rotational drive power can positively be transmitted from the rotor 524 through the first reduction wheel 532 via said time indicating gear train to the hour and minute hands 564, 546.

In the fourth embodiment, a time correction knob 566 is fixedly mounted on the minute wheel shaft 552 on the side of the upper case portion 512. When the knob 566 is rotated, the minute wheel and pinion 554, 558 are rotated to rotatably drive the center wheel pinion 544 and the hour hand wheel 560 into any desired correct position. At such a time, slippage is created between the center wheel pinion 544 and the center wheel 542 through any suitable slipping mechanism so that the synchronous motor section will not adversely be affected.

In accordance with the present invention, thus, the synchronous motor section includes the longitudinally extending C-shaped stator, the latter including its central axis on which at least the rotor and first reduction wheel in the synchronous motor section are positioned, and the time indicating gear trains disposed in a line on the extension of the central stator axis. This results in an elongated movement having its whole reduced size. Longer time indicating hands can rotatably be driven by a larger drive power from the synchronous motor section. The elongated movement can contributes to the increased flexibility on designing the external appearance of clocks. Particularly, the elongated movement is very advantageous for concealed movement type clocks.

Figure 15:
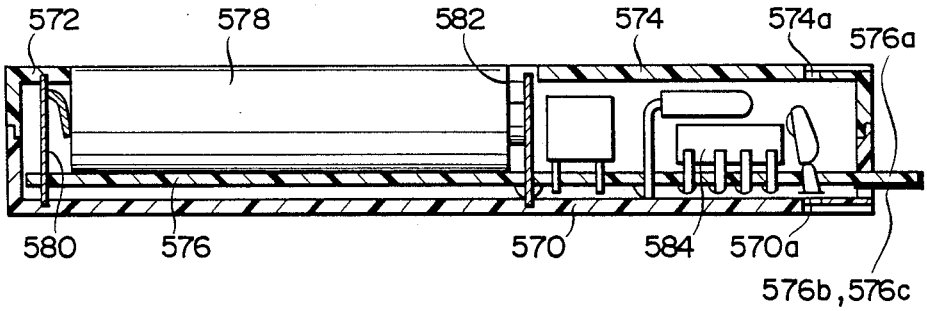
FIG. 15 is a longitudinally sectional view of a drive section in the embodiment shown in FIG. 13.

FIG. 15 shows another form of the drive section in the fourth embodiment of the present invention. The drive section includes a lower case portion 570, a battery lid 572 and an upper case portion 574, the lower case portion 570 fixedly receiving a drive circuit substrate 576.

The battery lid 572 can easily be mounted detachably on the lower case portion 570 in any well-known manner. A battery 578 can easily be mounted removably between battery holders 580 and 582 which are rigidly attached to the drive circuit substrate 576.

The drive circuit substrate 576 includes a drive circuit including a drive IC 584, which circuit is printed on the substrate 576. The drive circuit is adapted to supply a given drive signal, for example, a drive pulse of one Hz to the synchronous motor section in the aforementioned analog display section.

In the illustrated construction, the drive section has case portions 570 and 574 which are provided with groove means for mechanically connecting the drive section with the analog display section. The groove means comprises grooves **570*a* and 574*a* formed respectively on the right-hand ends of the case portions 570 and 574. These grooves 570*a* and 574*a* respectively engage pawls 510*a* and 512*a* formed on the case portions 510 and 512** of the analog display section to connect the drive section with the analog display section mechanically and easily.

The mechanical connection between the drive and display sections simultaneously causes an electrical connection therebetween. For such a purpose, the drive circuit substrate 576 has one end outwardly extending from its right-hand side as viewed in FIG. 15, as shown by **576*a* in FIG. 15. The bottom face of the drive circuit substrate 576 includes terminals 576*b* and 576*c*** formed thereon in a pattern.

In such a manner, the terminals **522*a* and 522*b* on the terminal plate 522 of the analog display section can be contacted, under pressure, by the terminals 576*b* and 576*c* on the drive circuit substrate 576** when the analog display section is mechanically connected with the drive section. This secures an electrical connection between the drive and display sections in positive and easy manner.

Each of the terminal plate 522 and circuit substrate 576 is made of a resilient material such as plastics. When the terminals **522*a* and 522*b* contact the terminals 576*b* and 576*c***, these terminals can more effectively be urged toward each other to provide a very well contact pressure. Thus, the electrical connection can be obtained very well under such a contact pressure due to the resilient deformation of the terminal plate and substrate.

Figure 16:
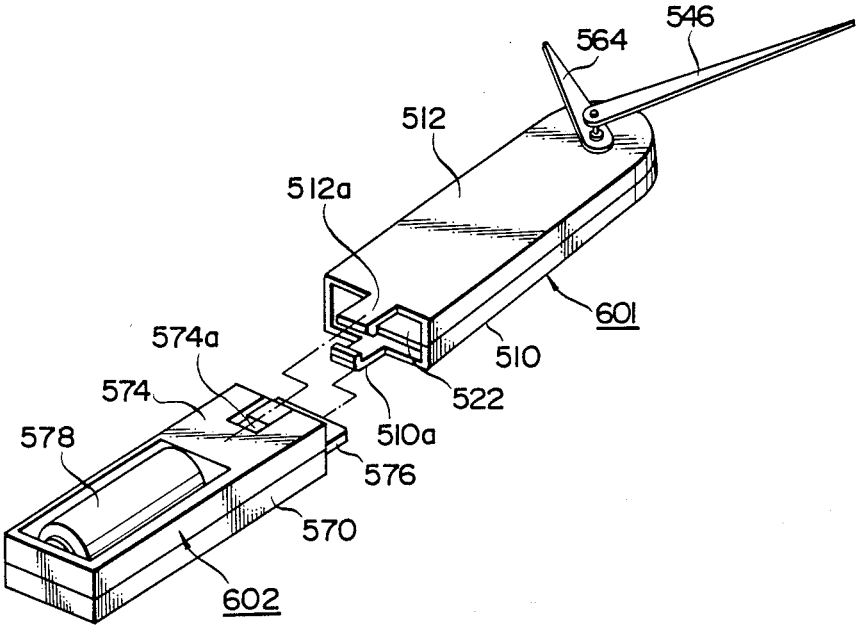
FIG. 16 is a perspective view showing the combination of the analog display section with the drive section in the embodiment shown in FIG. 13, 14 and 15.

FIG. 16 shows the assembled construction of the aforementioned clock movement in which an analog display section 601 can positively be connected with a drive section 602 by engaging the pawls **510*a* and 512*a* of the analog display section 601 with the grooves 574*a* (570*a*) of the drive section 602** in such a state that the drive and display sections are longitudinally aligned with each other.

In the illustrated construction, such a mechanical connection between the drive and display sections can easily provide an electrical connection between the terminal plate 522 of the analog display section 601 and the circuit substrate 576 of the drive section 602 due to the resilient contact of the respective terminals under pressure.

As seen from FIG. 16, the analog display section 601 is longitudinally aligned with the drive section 602 to form an elongated movement as a whole. The small-sized movement of such an elongated and thinned configuration can make the external design of the clock case more flexible.

Although the construction shown in FIG. 15 has been described as to the mechanical connection accomplished by using the pawls on the analog display section and the grooves on the drive section, such an arrangement may be reversed optionally in accordance with the present invention.

As will be apparent from the foregoing, the analog display and drive sections may be separated from each other and easily connected removably with each other by the use of a pawl and groove connection mechanism. Furthermore, the drive and display sections may easily be connected electrically with each other due to the resilient deformation of the terminals and circuit substrate. It is therefore possible to optionally combine one of different analog display sections with one of the different drive sections to form a new and unique movement.

I claim:

1. A clap movement for use in an elongated, slender clock case, said movement comprising:

an analog display section incorporating a synchronous motor section and a clock gear train and rotatably driving time indicating means, and a drive section receiving a motor drive circuit for supplying a drive signal to said synchronous motor section and battery means, said display and drive sections being electrically connected with each other through flexible wiring means, said analog display section comprising a C-shaped stator having a pair of parallel elongated legs, said stator including a central stator axis extending parallel to said elongated legs therebetween, the distal ends of said legs being opposed to each other to form stator poles facing each other, one of said legs including a stator coil wound thereabout, a rotor located between said stator poles and rotatably supported within said elongated, slender clock case for holding said stator, a first reduction wheel having a central axis located on said central stator axis and located within an opening formed between said stator poles and engaging a rotor pinion on said rotor, and a time indicating gear train operatively connected with said first reduction wheel, a distal wheel of said gear train rigidly supporting time indicating means, said first reduction wheel and said time indicating gear train are arranged in a line and supported between upper and lower case portions on a straight line extending from said central stator axis and parallel to said elongated legs, and said first reduction wheel and time indicating gear train are located within a range of height of said rotor.

2. A clock movement comprising:

an analog display section incorporating a synchronous motor section and a clock gear train and rotatably driving time indicating means, and a drive section receiving a motor drive circuit for supplying a given drive signal to said synchronous motor section and battery means, said display and drive sections being electrically connected with each other through flexible wiring means, said analog display section comprising an elongated C-shaped stator having a pair of parallel legs, said stator including a central stator axis extending parallel to said legs therebetween, the distal ends of said legs being opposed against each other to form stator poles, facing each other, one of said legs including a stator coil wound thereabout, a rotor located between said stator poles and rotatably supported within case means for holding said stator, a first reduction wheel having a central axis located on said central stator axis and located within an opening formed between said stator poles and engaging a rotor pinion on said rotor, and a time indicating gear train operatively connected with said first reduction wheel, a distal wheel of said gear train rigidly supporting time indicating means, said first reduction wheel and said time indicating gear train are arranged in a line and supported between upper and lower case portions on a straight or curved line extending from said central stator axis, and said first reduction wheel and time indicating gear train are located within the range of height of said rotor.

* * * * *